US009874023B1

(12) United States Patent
Inzeo

(10) Patent No.: US 9,874,023 B1
(45) Date of Patent: Jan. 23, 2018

(54) FASCIA MOUNTING BRACKET

(71) Applicant: Joseph A. Inzeo, West Allis, WI (US)

(72) Inventor: Joseph A. Inzeo, West Allis, WI (US)

(73) Assignee: METAL-ERA, INC., Waukesha, WI (US)

( * ) Notice: Subject to any disclaimer, the term of this patent is extended or adjusted under 35 U.S.C. 154(b) by 0 days.

(21) Appl. No.: 15/396,836

(22) Filed: Jan. 3, 2017

(51) Int. Cl.
*E04D 13/15* (2006.01)
*E04B 1/38* (2006.01)

(52) U.S. Cl.
CPC ..... *E04D 13/15* (2013.01); *E04B 2001/405* (2013.01)

(58) Field of Classification Search
CPC ..... E04D 13/15; E04B 2001/405
See application file for complete search history.

(56) References Cited

U.S. PATENT DOCUMENTS 5,031,367 A * 7/1991 Butzen ..... E04D 13/155 52/300
5,251,411 A * 10/1993 Kelley ..... E04D 13/064 156/290
5,272,846 A * 12/1993 Kelley ..... E04D 13/064 52/300
5,414,965 A * 5/1995 Kelley ..... E04D 13/064 52/60
6,725,617 B2 * 4/2004 Cox ..... E04B 5/10 52/302.6
7,451,572 B1 * 11/2008 Inzeo ..... E04D 3/405 52/300
7,866,095 B2 * 1/2011 Lin ..... E04D 13/15 52/741.3
8,161,692 B2 * 4/2012 Lin ..... E04D 13/15 52/58
8,869,466 B2 * 10/2014 Garcia ..... E04D 13/15 52/60

* cited by examiner

*Primary Examiner* — Andrew J Triggs
(74) *Attorney, Agent, or Firm* — Donald J. Ersler

(57) ABSTRACT

A fascia mounting bracket preferably includes a base member and a vertical attachment flange. The base member extends outward in a horizontal orientation from the vertical attachment flange. A lower portion of the vertical attachment flange extends below the base member and an upper portion of the vertical attachment flange extends above the base member. A plurality of staggered fastener openings are preferably formed through the base member. The fascia mounting bracket is preferably fabricated from an aluminum extrusion. The base member is inserted between a top of a nailer and a bottom of an insulation board. The fascia mounting bracket is secured to a building with a plurality of fasteners inserted through the plurality of fastener openings and screwed into the nailer. Fascia trim is attached to the top portion of the vertical attachment flange with a plurality of self-tapping fasteners.

12 Claims, 2 Drawing Sheets

FASCIA MOUNTING BRACKET

BACKGROUND OF THE INVENTION

1. Field of the Invention

The present invention relates generally to building trim and more specifically to a fascia mounting bracket, which may be used with a damaged wood nailer.

2. Discussion of the Prior Art

Fascia trim is typically mounted to a wood nailer, which is found on a top of a building. Sometimes the wood nailer may rot and not be suitable for attachment of the fascia trim. Lately, building designers have been using non-wood nailers and multiple layers of insulation. An attachment height of the fascia trim to the wood or non-wood nailer would be too low relative to a top of a building with multiple layers of insulation. The multiple layers of insulation could be as much as 6-8 inches thick. A device is needed to extend upward the attachment point of the fascia trim. U.S. Pat. No. 7,451,572 to Inzeo et al. discloses a roof fascia with extension cleat.

Accordingly, there is a clearly felt need in the art for a fascia mounting bracket, which may be used with a damaged wood nailer to mount fascia trim on a building or may be used to extend upward an attachment height of the fascia trim.

SUMMARY OF THE INVENTION

The present invention provides a fascia mounting bracket, which may be used to extend upward an attachment height of fascia trim. The fascia mounting bracket preferably includes a base member and a vertical attachment flange. The base member extends outward in a horizontal orientation from the vertical attachment flange. A lower portion of the vertical attachment flange extends below the base member and an upper portion of the vertical attachment flange extends above the base member. It is preferable that a height of the upper portion is about at least 1.5 inches and the lower portion about 0.5 inches. If multiple layers of insulation are used, the upper portion of the vertical attachment flange will have to be greater than the 1.5 inches. A plurality of staggered fastener openings are formed through the base member. The fascia mounting bracket is preferably fabricated from an aluminum extrusion. The base member is inserted between a top of a nailer and a bottom of an insulation board. The wood nailer is mounted to a top of a roof deck. The fascia mounting bracket is secured to a building with a plurality of fasteners inserted through the plurality of fastener openings and the plurality of fasteners screwed into the nailer. However, if the wood nailer is damaged, longer fasteners must be used, which will be screwed into the roof deck. The fascia trim is attached to the top portion of the vertical attachment flange with a plurality of self-tapping fasteners.

Accordingly, it is an object of the present invention to provide a fascia mounting bracket, which may be used with a damaged wood nailer to mount fascia trim on a building.

Finally, it is another object of the present invention to provide a fascia mounting bracket, which may be used to extend upward an attachment height of the fascia trim.

These and additional objects, advantages, features and benefits of the present invention will become apparent from the following specification.

DETAILED DESCRIPTION OF THE PREFERRED EMBODIMENTS

Figure 1:
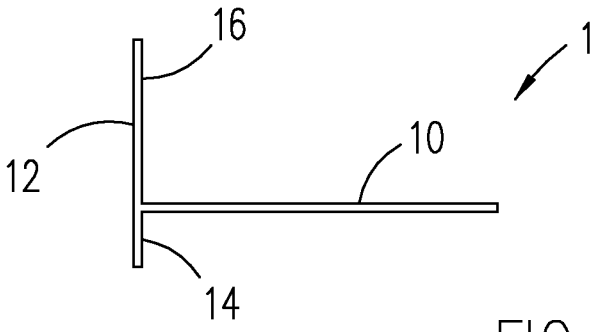
FIG. 1 is an end view of a fascia mounting bracket in accordance with the present invention.
Figure 2:
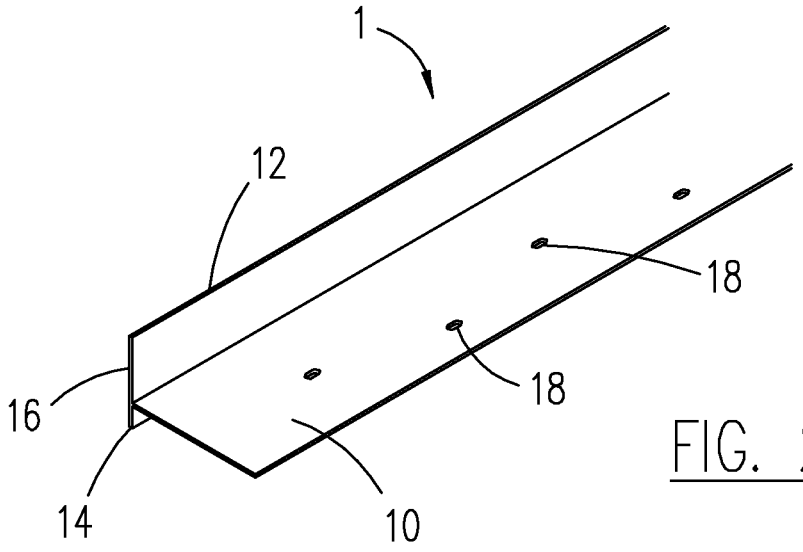
FIG. 2 is a perspective view of a fascia mounting bracket in accordance with the present invention.
Figure 3:
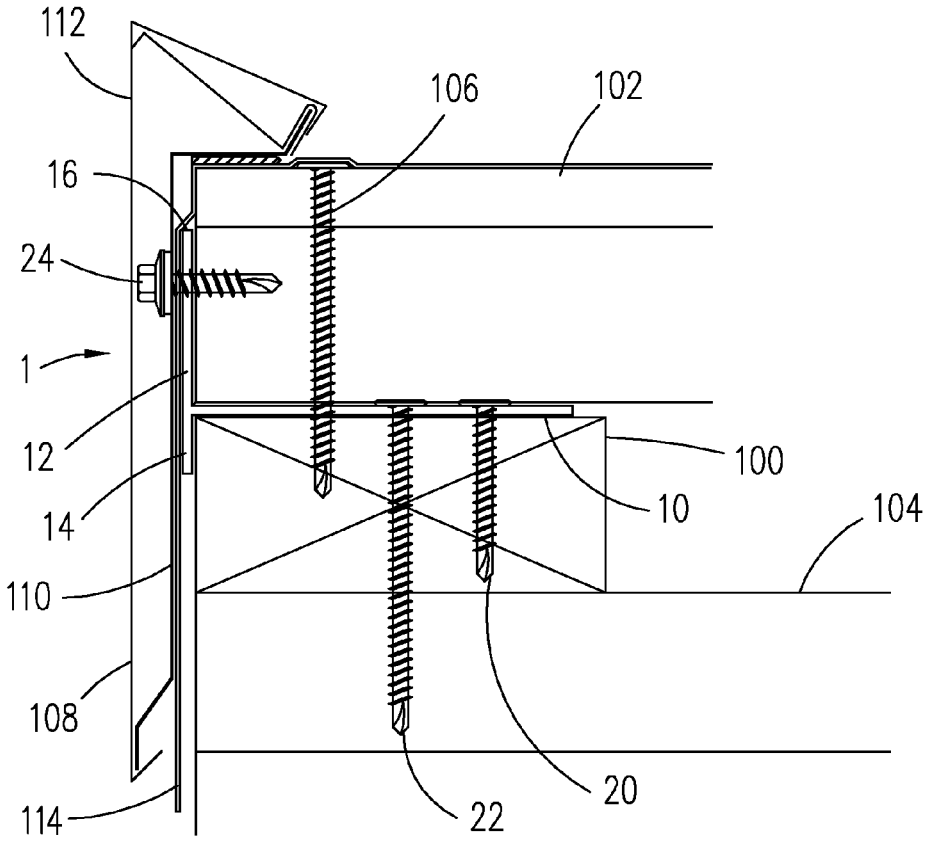
FIG. 3 is a cross sectional view of a fascia mounting bracket attached to either a wood nailer or a roof deck, and fascia trim attached to the fascia mounting bracket in accordance with the present invention.

With reference now to the drawings, and particularly to FIG. 2, there is shown a perspective view of a fascia mounting bracket 1. With reference to FIGS. 1 and 3, the fascia mounting bracket 1 preferably includes a base member 10 and a vertical attachment flange 12. The base member 10 extends outward in a horizontal orientation from the vertical attachment flange 12. A lower portion 14 of the vertical attachment flange 12 extends below the base member 10 and an upper portion 16 of the vertical attachment flange 12 extends above the base member 10. It is preferable that a height of the upper portion 16 is about at least 1.5 inches and the lower portion 14 is about 0.5 inches. If multiple layers of insulation are used, the upper portion 16 of the vertical attachment flange 12 will have to be greater than 1.5 inches. A plurality of staggered fastener openings 18 are preferably formed through the base member 10. The fascia mounting bracket 1 is preferably fabricated from an aluminum extrusion. The base member 10 is inserted between a top of a wood nailer 100 and a bottom of an insulation board 102. The wood nailer 100 is mounted to a top of a roof deck 104. The fascia mounting bracket 1 is secured to a building with a plurality of fasteners 20 inserted through the plurality of fastener openings 18 and screwed into the wood nailer 100 or a non-wood nailer. The plurality of fastener openings are preferably slots but could be any suitable shape. However, if the wood nailer 100 is damaged, longer fasteners 22 must be used, which will be screwed into the roof deck 104. The insulation board 102 is attached to the wood nailer with a plurality of fasteners 106. Fascia trim 108 includes a base portion 110 and a cover portion 112. The base portion 110 is attached to the top portion 16 of the vertical attachment flange 12 with a plurality of self-tapping fasteners 24. However, other designs of fascia trim may also be used. With reference to FIG. 3, a roof membrane 114 is placed over a top of the insulation board 102, and between the vertical attachment flange 12 and the base portion 110 of the fascia trim 108.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A fascia mounting bracket comprising:

a base member having a plurality of openings formed therethrough; and a vertical flange having said base member extending horizontally outward therefrom, near a bottom of said vertical flange, a lower portion is created below said base member and an upper portion is created above said base member, a height of said lower portion is less than a height of said upper portion, wherein a roof membrane is capable of being retained between a front surface of said vertical flange and fascia trim.

2. The fascia mounting bracket of claim 1 wherein:

said fascia mounting bracket is fabricated from an aluminum extrusion.

3. The fascia mounting bracket of claim 1 wherein:

said base member is secured to a nailer of a building with a plurality of fasteners.

4. The fascia mounting bracket of claim 1 wherein:

said base member is secured to a roof deck of a building with a plurality of fasteners.

5. A fascia mounting bracket comprising:

a base member having a plurality of staggered openings formed therethrough; and a vertical flange having said base member extending horizontally outward therefrom, near a bottom of said vertical flange, a lower portion is created below said base member and an upper portion is created above said base member, a height of said lower portion is less than a height of said upper portion, wherein a roof membrane is capable of being retained between a front surface of said vertical flange and fascia trim.

6. The fascia mounting bracket of claim 5 wherein:

said fascia mounting bracket is fabricated from an aluminum extrusion.

7. The fascia mounting bracket of claim 5 wherein:

said base member is secured to a nailer of a building with a plurality of fasteners.

8. The fascia mounting bracket of claim 5 wherein:

said base member is secured to a roof deck of a building with a plurality of fasteners.

9. A fascia mounting bracket in combination with fascia trim, comprising:

a base member having a plurality of openings formed therethrough;

a vertical flange having said base member extending horizontally outward near a bottom of said vertical flange, a lower portion is created below said base member and an upper portion is created above said base member, a height of said lower portion is less than a height of said upper portion; and fascia trim is mounted to said upper portion with a plurality of self-tapping fasteners, wherein a roof membrane is capable of being retained between a front surface of said vertical flange and said fascia trim.

10. The fascia mounting bracket in combination with fascia trim of claim 9 wherein:

said fascia mounting bracket is fabricated from an aluminum extrusion.

11. The fascia mounting bracket in combination with fascia trim of claim 9 wherein:

said base member is secured to a nailer of a building with a plurality of fasteners.

12. The fascia mounting bracket in combination with fascia trim of claim 9 wherein:

said base member is secured to a roof deck of a building with a plurality of fasteners.

* * * * *